United States Patent [19]

Scheiner

[11] 4,349,792

[45] Sep. 14, 1982

[54] PI PAD ATTENUATOR

[75] Inventor: Harry Scheiner, New City, N.Y.

[73] Assignee: Kings Electronics Co., Inc., Tuckahoe, N.Y.

[21] Appl. No.: 924,682

[22] Filed: Jul. 14, 1978

[51] Int. Cl.[3] ..... H01P 1/22

[52] U.S. Cl. ..... 333/81 A; 29/620

[58] Field of Search ..... 333/81 R, 81 A; 323/94 R; 338/216, 306–309

[56] References Cited

U.S. PATENT DOCUMENTS 3,260,971 7/1966 Bacher et al. ..... 333/81 R 3,680,013 7/1972 Pye ..... 333/81 R 4,060,780 11/1977 Nishida ..... 333/81 A 4,107,632 8/1978 Dawson ..... 333/81 A

*Primary Examiner*—Paul L. Gensler

*Attorney, Agent, or Firm*—Linda G. Bierman; Jordan B. Bierman

[57] ABSTRACT

A pi pad attenuator for microwave systems is formed on an insulating substrate in the form of a small card or chip. Resist material covers the substrate, and input and output conductors are plated over the resist in the desired configuration. Resist material is removed to leave conductors interconnected in a predetermined pattern by individual sections of resist to form the pi pad. Characteristics of the attenuator are determined by the area of the remaining resist sections and/or the thickness of the applied resist.

2 Claims, 6 Drawing Figures

PI PAD ATTENUATOR

This invention relates to the type of attenuator capable of being formed on a small substrate such as a chip or card and insertable in a small coaxial line or waveguide.

Attenuators of this type are already known in the art as exemplified, for example, in the U.S. Pat. Nos. to Weinschel 3,157,846 and Hewlett et al 3,227,975, which illustrate attenuator cards or plates mounted within a sleeve which in turn is electrically connected in a high-frequency energy transmission path such as a coaxial line or cable.

My invention is directed to a novel from of pi pad attenuator likewise primarily adapted for use with a coaxial high-frequency line, and fixed thereto in a suitable mounting of the type already known in the art, but which, by reason of its configuration, structural arrangement and method of fabricating, provides advantages over comparable and presently known attenuators. Such an attenuator is capable of use over a frequency path of 0–18 gigaherz.

Among the advantages of the present attenuator there is not only its low cost in both material and manufacturing, but also the ease in which desired attenuation characteristics can be obtained in the size, shape and thickness of the resist areas.

Accordingly, an object of this invention is to provide a low-cost pi pad attenuator particularly suitable for use with coaxial transmission lines and one whose characteristics can be readily fixed to obtain the desired attenuator parameters. The physical arrangement of this pi pad attenuator also leads to an inexpensive and accurate method of manufacturing the same.

Figure 1A:
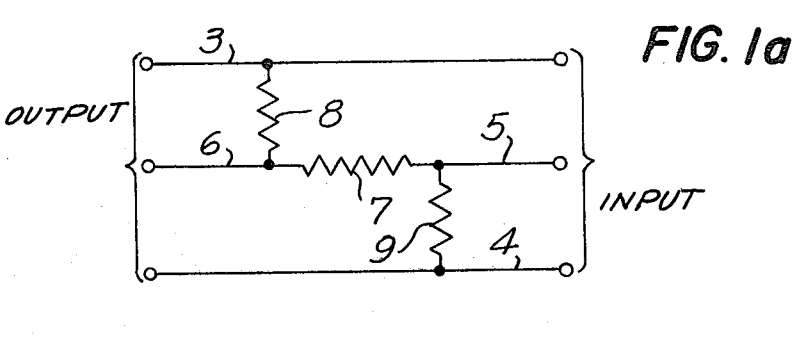
Figure 1:
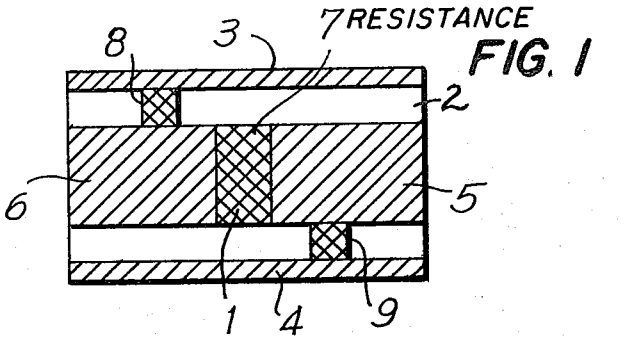
Figure 2A:
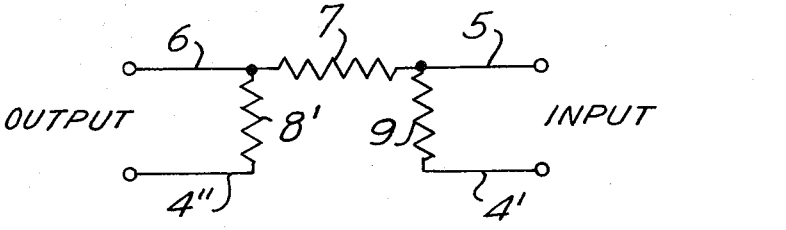
Figure 2:
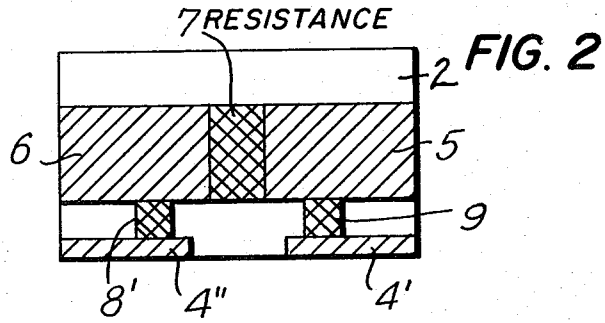
Figure 3A:
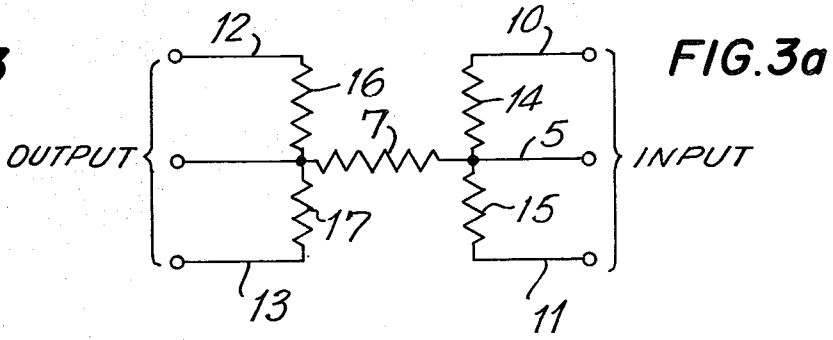
Figure 3:
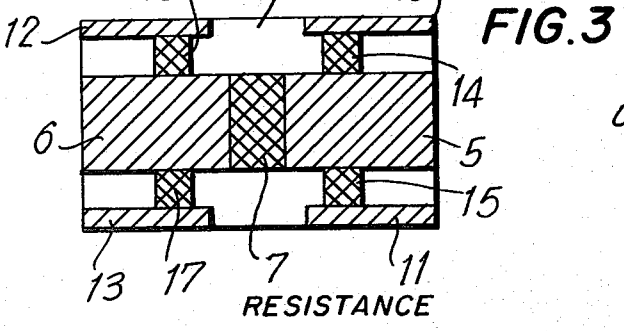

The invention has been described with reference to the attached drawings in which:

FIG. 1 is a plane view of a preferred form of pi pad attenuator in accordance with the present invention;

FIG. 1*a* illustrates the equivalent electrical circuit of the pi pad attenuator shown in FIG. 1;

FIG. 2 is a plane view of a modified form of attenuator;

FIG. 2*a* shows the equivalent electrical circuit of the attenuator illustrated in FIG. 2;

FIG. 3 is a plane view of still another modified form of attenuator; and

FIG. 3*a* is a circuit diagram showing the equivalent electrical circuit of the attenuator illustrated in FIG. 3.

In the form of invention shown in FIG. 1, a layer of any well-known resistive material suitable for the purpose, such as nichrome, generally indicated at 1, is deposited upon a thin card or chip of suitable insulating material, preferably formed of a ceramic, forming substrate 2. Thin strips 3 and 4 of conductive material are plated over the two outer edges of the unit effectively shortcircuiting the resistive material and forming outer conductors, while center conductors 5 and 6 of the same material are plated over the central portion of the card, leaving, however, an unplated central area 7 of exposed resist. The cross-sectional area of this exposed section will have been predetermined in accordance with the desired characteristics of the attenuator and may be checked by suitable d.c. measurements as known in the art.

The remaining resistive material is then removed from the remaining exposed portion of the substrate as by a laser or by air-jet or rotary abrasion, leaving, however, connective areas of resist 8 and 9 respectively between the inner and outer conductors 3-6 and 5-4, the size of such areas in conjunction with the size of area 7 again being predetermined in accordance with the attenuation characteristics desired.

The resulting structure, the electrical equivalent of which is shown in FIG. 1*a*, thereby constitutes an attenuator pi pad whose input connections are formed of plated sections 4 and 5, and whose output of plated sections 3 and 6, resist areas 7, 8 and 9, completing the electrical circuit.

The completed unit may be mounted in a coaxial structure in a manner already known in the art, with strips 3 and 4 being clamped or otherwise suitably attached to the outer conductor, for example, of a coaxial cable, while the center elements 5 and 6 are suitably attached to the opposed center conductors.

In the form of invention shown in FIG. 2, the electrical circuit (FIG. 2*a*) is the equivalent of that shown in FIG. 1*a*, but the structural arrangement is slightly different from that illustrated in FIG. 1.

In this case, outer conductive strip 3 has been eliminated, while the other outer conductor strip has been broken up into two independent elements 4' and 4''. The center conductive strips 5 and 6 and central resist section 7 remain the same. However, resist section 9 is now connected between center conductor 5 and the partial outer conductor 4'. Resist section 8' has been shifted and connects center conductor 6 to partial outer conductor 4''.

The method of forming the pi pad shown in FIG. 2, in all ways follows the method used in forming the pi pad of FIG. 1. The end result, however, provides a slightly different mechanical arrangement which may be used when the configuration shown in FIG. 1 is not otherwise suitable, as for connection purposes.

FIG. 3 shows a modified form of an attenuator pi pad in which the resistive elements are distributed. This type of arrangement can provide desired impedance matching properties different from those of the pi pad of FIGS. 1 and 2. In this case, the center conductors 5 and 6 and intermediate resist section 7 are formed as in FIGS. 1 and 2. However, in this proposed arrangement, both outer conductors are split as indicated at 10, 11, 12 and 13, with individual resist sections 14 and 15, respectively, between input conductors 10, 11 and center conductors 5. On the output side, resist sections 16, 17 connect center conductor 6, respectively, with output conductors 12 and 13. The equivalent electrical circuit is shown in FIG. 3*a*.

Advantages of any of the pi pad attenuators above described are not only in their ease of manufacture, but also the ease in which attenuator characteristics can be altered or corrected. By following a suitable d.c. test, the resist area can be decreased by additional abrading off or increased by the addition of resist material, to obtain the exact characteristics desired. A decrease in resist material can also be obtained by decreasing the thickness of the resist sections, as by surface abrasion, although removal of resist from the substrate to decrease the area of the resist sections has been found to be preferable.

The physical size of the attenuator pi pad unit according to the present invention is determined in accordance with the size of the coaxial conductor with which it is to be used, which, in turn, is relative to the transmission frequency. The sole practical limitation results from the fact that as frequency decreases and cable size increases, the advantages of the proposed pi pad structure over conventional mechanical pi pad attenuators becomes less pronounced.

The size and shape of the illustrated pi pads, the dimensions of the conductive strips and the area of the resist sections, as indicated in the drawings, have been chosen solely to illustrate the principles of the present invention. In practical size, they would in general be too small to show necessary detail without enlargement. In particular, the size and shape of the resist areas are varied in accordance with the desired attenuator characteristics. Preferably, however, the width of the outer conductor is made as small as practicable to minimize capacitive effects.

Accordingly, the described invention is not limited to the specific examples given, but only as set forth in the claims which follow.

What is claimed is:

1. A pi pad attenuator comprising an insulating substrate, a pair of transversely spaced, longitudinally extending input conductors printed on said substrate, of which one input conductor is centrally positioned and extends from one end of the substrate in a substantially straight line only partially the length of the substrate, a pair of transversely spaced, longitudinally extending output conductors printed on said substrate, of which one output conductor is centrally positioned and extends from the other end of said substrate in a substantially straight line only partially the length of said substrate and in alignment with said one input conductor, a first discrete area of resistive material on said substrate interconnecting the opposed ends of said one input and output conductors, and second and third individual discrete areas of resistive material in said substrate respectively interconnecting each pair of input and output conductors, and in which said other input and output conductors extend along one longitudinal edge of said substrate and are longitudinally spaced from one another.

2. Attenuator pad according to claim 1 in which said other input and output conductors extend along each longitudinal edge of said substrate for a distance substantially equal to the corresponding central input and output conductors, and in which the resistive material interconnecting the respective input and output conductors extends between the centrally positioned conductor of each pair and both of the two input and output conductors spaced therefrom along the edges.

* * * * *